US010806990B2

(12) United States Patent
Cho et al.

(10) Patent No.: US 10,806,990 B2
(45) Date of Patent: Oct. 20, 2020

(54) INCLINED STRUCTURE OF COURT FLOOR FOR AUTOMATIC SUPPLY IN BALL GAME

(71) Applicants: Byoung Koo Cho, Daejeon (KR); Chang Suk Han, Daegu (KR); Chang Hee Chun, Cheongju-si (KR); Bo Sub Kim, Daegu (KR); Yeon Uk Jeong, Seoul (KR)

(72) Inventors: Byoung Koo Cho, Daejeon (KR); Chang Suk Han, Daegu (KR); Chang Hee Chun, Cheongju-si (KR); Bo Sub Kim, Daegu (KR); Yeon Uk Jeong, Seoul (KR)

( * ) Notice: Subject to any disclaimer, the term of this patent is extended or adjusted under 35 U.S.C. 154(b) by 0 days.

(21) Appl. No.: 16/028,613

(22) Filed: Jul. 6, 2018

(65) Prior Publication Data

US 2020/0009448 A1 Jan. 9, 2020

(51) Int. Cl.
*A63C 19/02* (2006.01)

(52) U.S. Cl.
CPC ..... *A63C 19/02* (2013.01)

(58) Field of Classification Search
CPC ..... A63C 19/02
See application file for complete search history.

(56) References Cited

U.S. PATENT DOCUMENTS

| | | | | |
|---|---|---|---|---|
| 2,761,181 | A * | 9/1956 | Legeman | E04H 3/14 52/169.1 |
| 3,989,245 | A * | 11/1976 | Augustine, Jr. | A63B 47/025 473/431 |
| 4,422,632 | A | 12/1983 | Trottet | |
| 4,949,967 | A * | 8/1990 | Todokoro | A63F 7/0652 273/108.52 |
| 2011/0192096 | A1* | 8/2011 | Koberinski | E04B 5/43 52/126.6 |
| 2015/0038247 | A1* | 2/2015 | Eltz, III | A63B 67/02 473/163 |
| 2017/0348582 | A1* | 12/2017 | Cho | A63B 69/40 |

FOREIGN PATENT DOCUMENTS

| | | | |
|---|---|---|---|
| EP | 3246075 | A | 11/2017 |
| FR | 2315570 | A | 1/1977 |
| JP | H02-92380 | A | 4/1990 |

* cited by examiner

*Primary Examiner* — Jeffrey S Vanderveen
(74) *Attorney, Agent, or Firm* — KORUS Patent, LLC; Seong Il Jeong

(57) ABSTRACT

The present invention relates to an inclined structure of a court floor having a new structure for easily collecting automatically supplying balls used in practice. According to an inclined structure of a court floor according to the present disclosure, the ball used for practice can be rolled down outwardly along the slope of the court, and then be collected in the collecting ditch and gathered in one place, so there is no need to collect scattered balls separately.

1 Claim, 8 Drawing Sheets

INCLINED STRUCTURE OF COURT FLOOR FOR AUTOMATIC SUPPLY IN BALL GAME

BACKGROUND OF THE INVENTION

1. Field of the Invention

The present disclosure relates to an inclined structure of a court floor having a new structure for easily collecting and automatically supplying balls used in practice.

2. Description of the Related Art

In recent years, an increasing number of people are enjoying ball games such as basketball, futsal, volleyball, tennis, and foot volleyball.

However, since the court of a stadium where such ball games take place is configured to form a horizontal plane, the balls used in the practice are scattered and spread out around the court when a player is practicing. There is a problem wherein the balls scattered during practice as such must be collected again, which is very inconvenient.

Therefore, a new method for solving such a problem is required.

As a prior art related thereto, there is Granted Korean Patent Publication No. 10-0394902.

SUMMARY OF THE INVENTION

The present disclosure is directed to providing an inclined structure for a court floor having a new structure for easily collecting and automatically supplying balls used in practice.

In an aspect of the present disclosure, an inclined structure of a court floor may be provided, wherein a top surface of a court A of a ball game stadium formed to enable ball games to be played is inclined outwardly such that a ball used for playing or practice rolls outwardly and is collected, a support layer 11 having an inclined upper surface is formed on a bottom surface 10 of the court A, the support layer 11 is provided to correspond to an outer circumferential portion of the court A, a mold 13 configured by assembling a wooden panel into a quadrilateral frame shape and a support member 14 arranged inside the mold 13 and joined to a metal pipe to form an inclined surface whose upper surface corresponds to the inclined surface of the support layer 11 is included, wherein concrete is laid inside the mold 13, the upper surface of the concrete is evened out and hardened so as to form a surface having a same slope as the upper surface of the support member 14 such that the upper surface of the concrete corresponds to the upper surface of the support member 14, the upper surface of the hardened concrete is finished through a grinder or an abrader, a flooring 12 selected from wood, synthetic resin or rubber based on a type of the stadium is formed in a panel shape on the upper surface of the support layer 11 so as to be adhered and fixed to cover the support layer 11, or a flooring is configured by applying a flooring component of synthetic resin or rubber material on the upper surface of the support layer 11 at a constant thickness, the ball used for playing or practice is discharged outside of the court A along an inclined surface of the court A, the inclined surface of the court A configured to have an entire upper surface inclining downwards towards opposite sides, or configured to have only the opposite sides of the upper surface inclining downwards towards the opposite sides, or configured to have the opposite sides and a rear side inclining downwards towards the opposite sides and the rear side, respectfully, or configured to have a dome shape inclining downwards to an outer side from a center portion, such that the ball is collected in a collecting ditch 1 inclined to one side of the outer circumferential portion of the court A and then gathered to one side along the slope of the collecting ditch 1, an inclination of the support layer 11 is formed in a range of 0.1° to 3°, and a portion where the inclination of each edge of the court A starts is rounded and gently formed.

According to an inclined structure of a court floor structure for automatic supply in a ball game according to the present disclosure, the ball used for practice can be rolled down outwardly along the slope of the court, and then be collected in the collecting ditch and gathered in one place, so there is no need to collect scattered balls separately.

DETAILED DESCRIPTION OF THE EMBODIMENTS

The present invention will now be described in detail with reference to the accompanying drawings.

Figure 1:
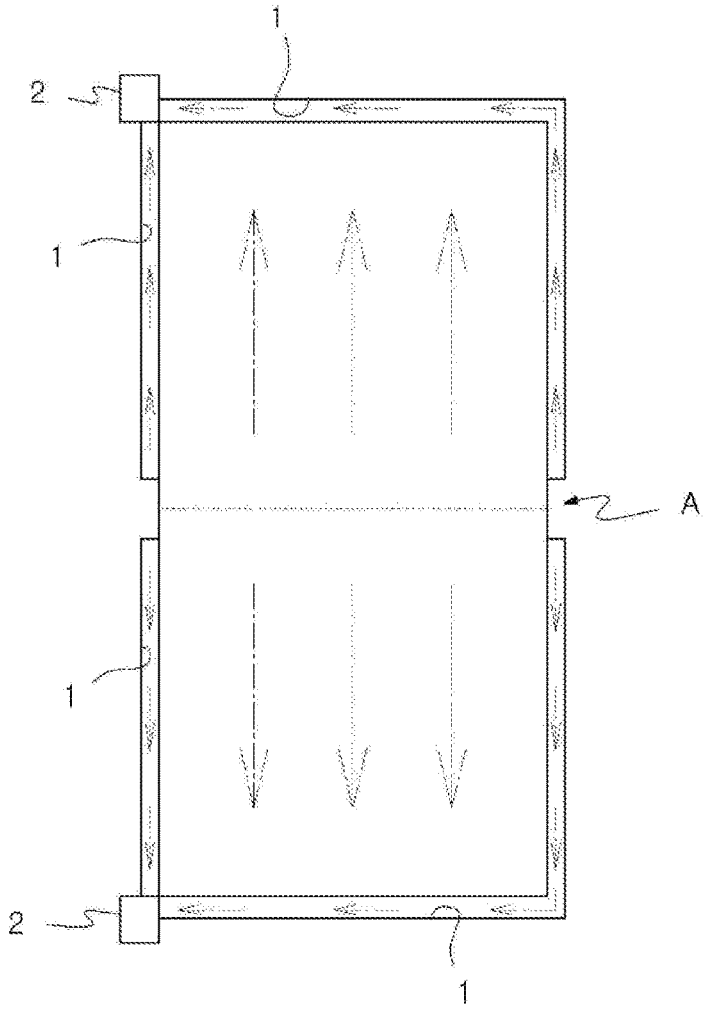
FIG. 1 is a plan view showing an inclined structure of a court floor according to the present disclosure.
Figure 2:
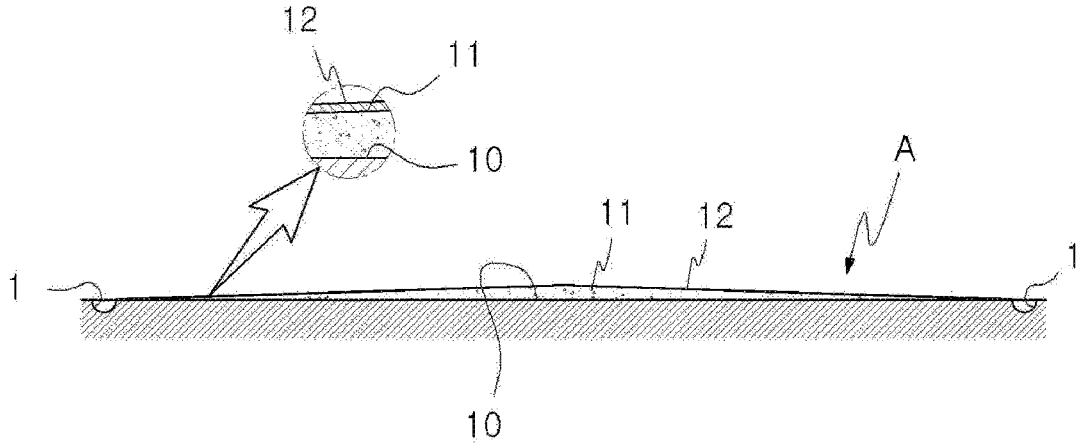
FIG. 2 is a side sectional view showing an inclined structure of a court floor according to the present disclosure.

FIG. 1 and FIG. 2 illustrate a court structure of a ball game stadium according to the present invention, which is applied to a court A of a stadium having a length of 12 m and a width of 6 m.

According to this structure, the upper surface of the court A is inclined outwardly, and a collecting ditch 1 inclined to one side is formed on the outer circumference of court A so that the ball used for playing or practice rolls outwardly and is collected in the collecting ditch 1, and then gathered to one side along the slope of the collecting ditch 1.

At this time, as shown in FIG. 1, the court A is formed such that the entire court A is inclined in a front-rear direction about the central portion.

In describing in more detail, the court A forms a support layer 11 having an upper surface inclined in the front-rear direction on the bottom surface 10, the support layer 11 being prepared with various materials that do not affect sports games such as concrete, ocher and the like. A flooring 12 is configured by being laminated on the upper surface of the support layer 11.

To this end, the bottom surface 10 is shown as being firmly hardened so that the ground surface forms a plane, or on the ground surface, a separate member is laminated on the top surface of the ground surface as to form a plane.

In addition, the support layer 11 is constructed to have an upper surface that is inclined at an exact angle via the following steps: providing a mold 13 so as to correspond to an outer circumferential portion of the court A, placing a plurality of support members 14 configured to form an upper surface having an inclined surface corresponding to an inclined surface of the support layer 11 into the mold 13 such that the plurality of support members 14 are spaced apart in an mutually lateral direction, laying concrete into the mold 13, evening out the upper surface of the concrete so as to be corresponding to the inclined surface of the support member 14 and then hardening, finishing the upper surface of the hardened concrete using a grinder or an abrader or the like.

In addition, the inclination of the support layer 11 is formed in a range of 0.1° to 3°, preferably 0.5° to 1.5°. As such, the inclination of the support layer 11 is set in the range of 0.1° to 3° to solve the problems that occur. When the inclination of the supporting layer 11 is 0.1° or less, it forms a plane state which makes it impossible to gather balls used in a sports game to a collecting ditch 1 and when the inclination of the supporting layer 11 is 3° or more, the inclination (slope) is so great that the sports games cannot be performed freely.

Referring to an example wherein the inclination is set from 0.5° to 1.5°, in the case of a wooden material having small frictional force set to 0.7°, balls that have air pumped in, for example, a soccer ball, volleyball, basketball and the like are gathered in a collecting ditch 1, but a tennis ball, baseball, or pingpong ball and the like do not have the appropriate surface material or size and thus are hard to roll around.

In the case of a wooden, urethane, or PP(plastic) flooring having an inclination of 1.5°, with slight difference in time all balls of ball games are gathered in the collecting ditch 1.

Generally, starting from an inclination of 1.5° or more, it becomes uncomfortable to play the ball games, and once the inclination reaches around 3°, there is much difficulty in playing the sports.

In a case of a grass stadium, even when set to 3°, the ball couldn't reach the collecting ditch.

Because such setting of inclination changes the stress fatigue of a player and the possibility of collecting a ball, it is important to set the a preferable inclination.

Figure 3:
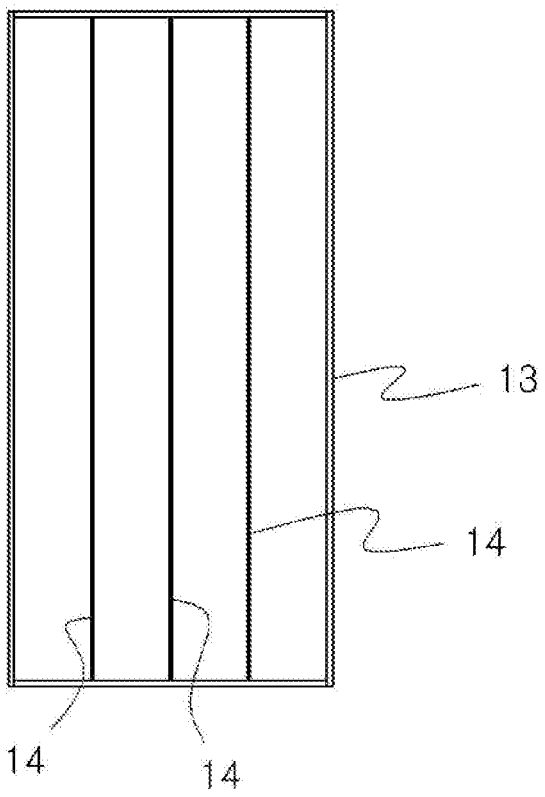
FIG. 3 is a plan view showing a mold for constructing a support layer of an inclined structure of a court floor according to the present disclosure.
Figure 4:
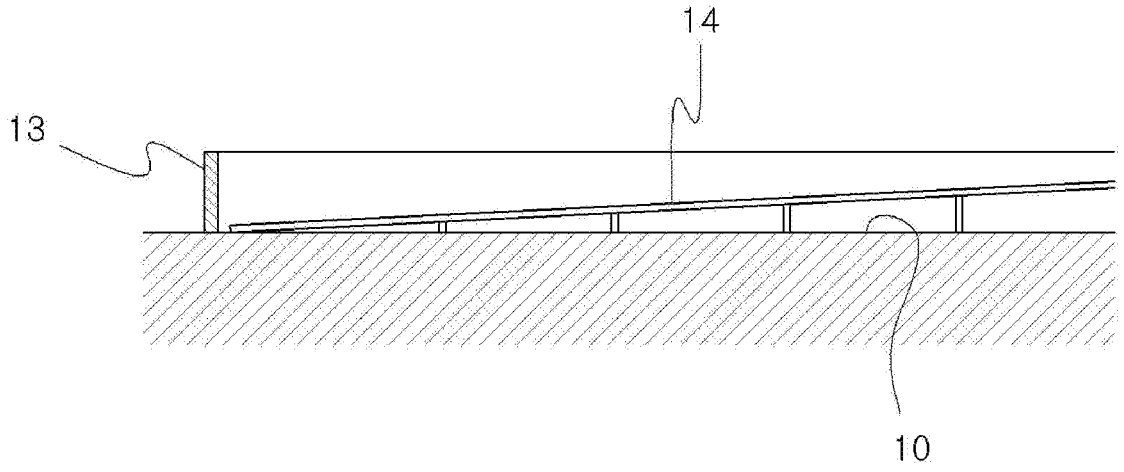
FIG. 4 is a side sectional view of a mold for constructing a support layer of an inclined structure of a court floor according to the present disclosure.

As shown in FIGS. 3 and 4, the mold is configured by assembling a wooden panel in a quadrilateral frame shape.

The support member 14 is formed by welding a metal pipe having high strength.

In addition, when the upper surface of the concrete laid in the mold 13 is evened out, by pushing a wide bull floating tool having a lateral width that is bigger than the spacing of the support member 14 in a front-rear direction while placed on top of the upper surface of the support member 14 to widely spread the concrete, the upper surface of the concrete can form a plane having the same slope as that of the upper surface of the support member 14.

Since the bull floating tool is generally used when evening out the upper surface of concrete placed on a bottom surface, a detailed description thereof will be omitted.

A flooring 12 is made of wood, synthetic resin or rubber and is formed in a small panel shape so that a plurality of the same are adhered and fixed on the upper surface of the support layer 11 so as to cover the support layer 11, or is applied so as to have a constant thickness on the upper surface.

At this time, the type of the flooring 12 depends on the type of the stadium.

Further, the inclination angle of the court A is appropriately adjusted according to the type of ball and the type of the flooring 12.

In addition, the collecting ditch 1 is provided with a ball feeding means 2 for providing the ball collected by the collecting ditch 1 to the players, so that the ball collected in the collecting ditch 1 is automatically supplied to the players.

According to the inclined structure of the court floor configured as described above, the ball used for practice rolls outwardly along the slope of the court A, as indicated by an arrow in FIG. 1, and then is collected in the collecting ditch 1 and gathered in one place. Thus there is an advantage that there is no need to collect scattered balls separately.

Further, the court A comprises a support layer 11 made of a concrete material having an inclined upper surface on the bottom surface 10 and a flooring 12 configured by laminating wood, synthetic resin or rubber on the upper surface of the support layer 11. Thus, there is an advantage that the inclined surface of the court A can be freely adjusted.

Particularly, there is an advantage that the support layer 11 and the flooring 12 placed on top of the upper surface of the support layer 11 can be formed to be an exact plane surface via the following steps: providing a mold 13 so as to correspond to an outer circumferential portion of the court A, placing a plurality of support members 14 configured to form an upper surface having an inclined surface corresponding to an inclined surface of the support layer 11 into the mold 13 such that the plurality of support members 14 are spaced apart in an mutually lateral direction, laying concrete into the mold 13, evening out the upper surface of the concrete so as to be corresponding to the inclined surface of the support member 14 and then hardening, finishing the upper surface of the hardened concrete using a grinder or an abrader or the like.

Figure 5:
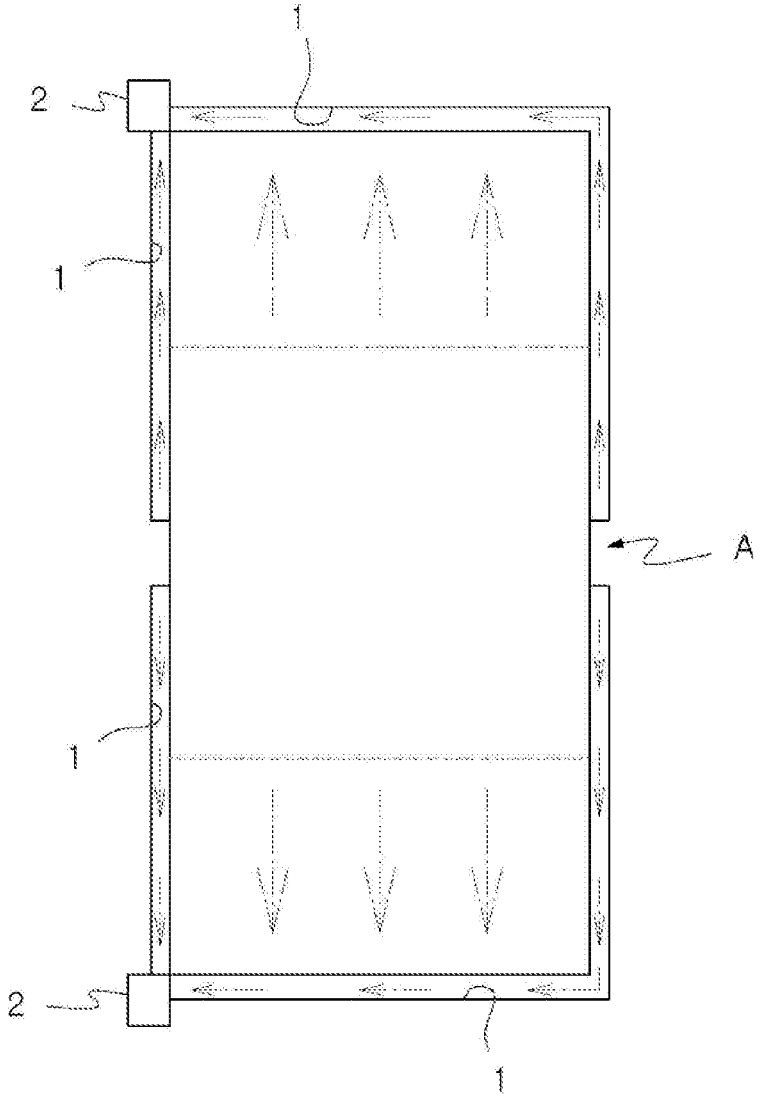
FIGS. 5 to 10 are plan views showing a modified example of an inclined structure of a court floor according to the present disclosure.

In the present embodiment, the entirety of the court A is inclined in the front-rear direction with respect to the center portion. However, as shown in FIG. 5, only half of the court A may be inclined in the front-rear direction.

Figure 6:
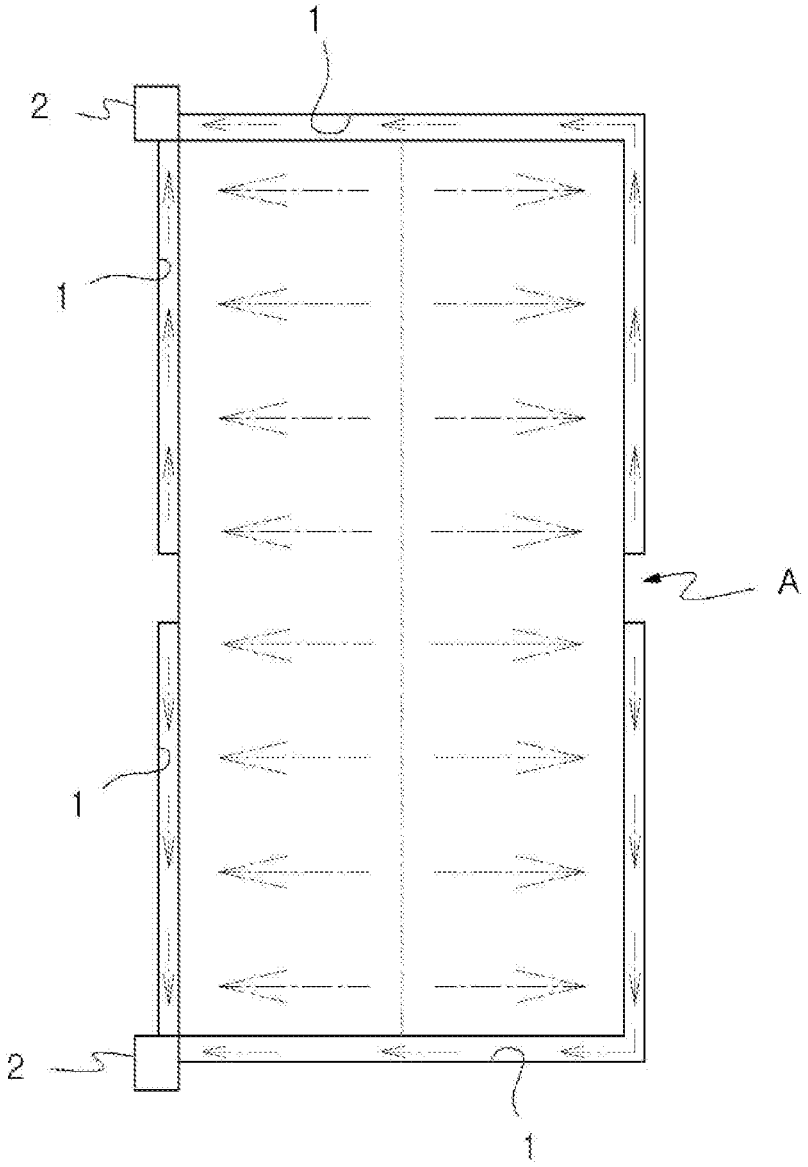
Figure 7:
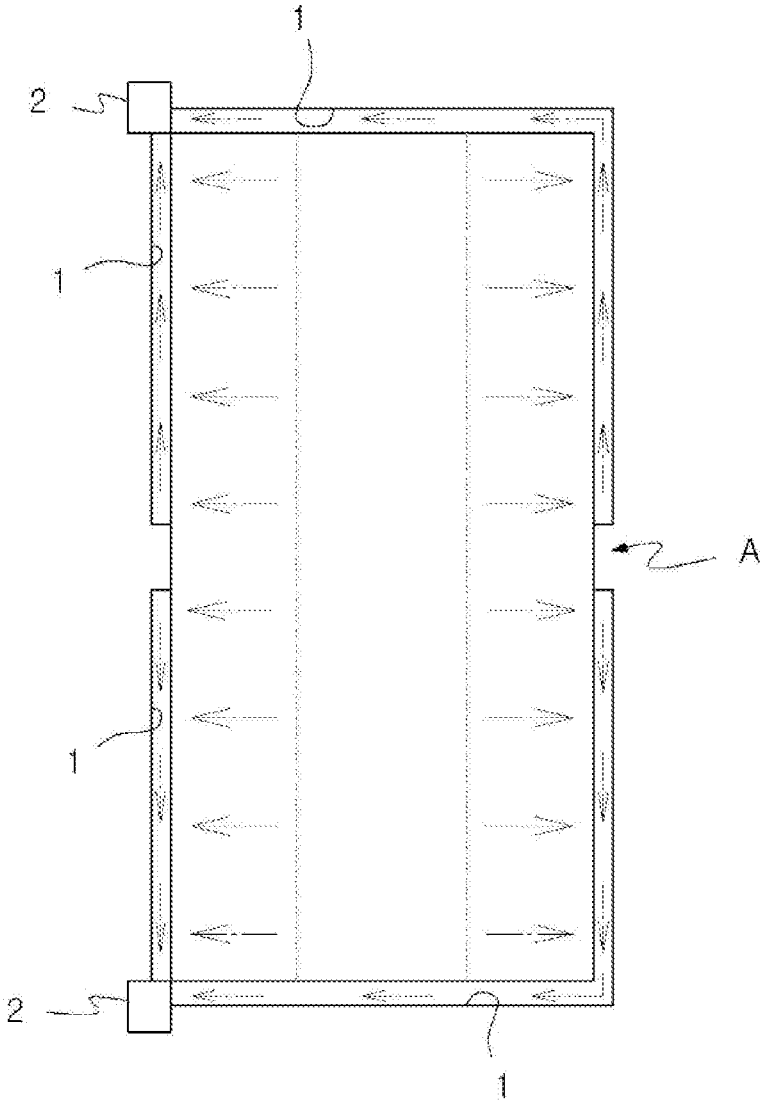
Figure 8:
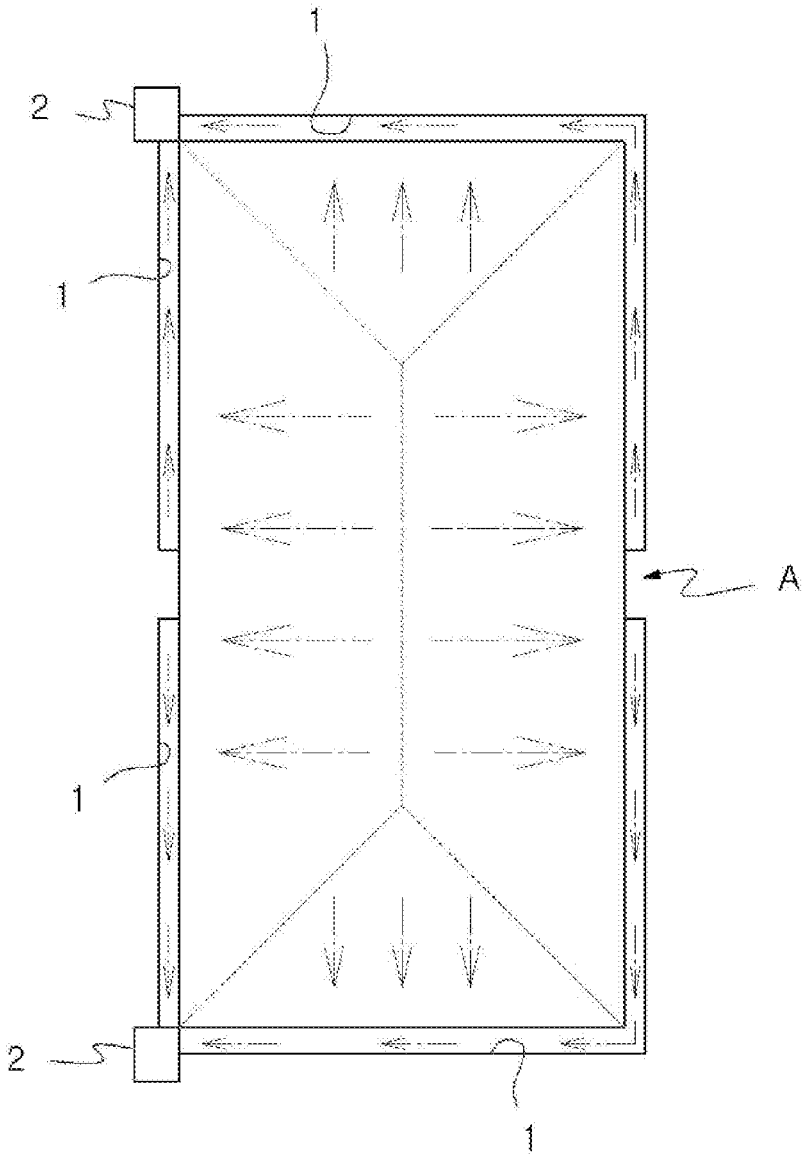
Figure 9:
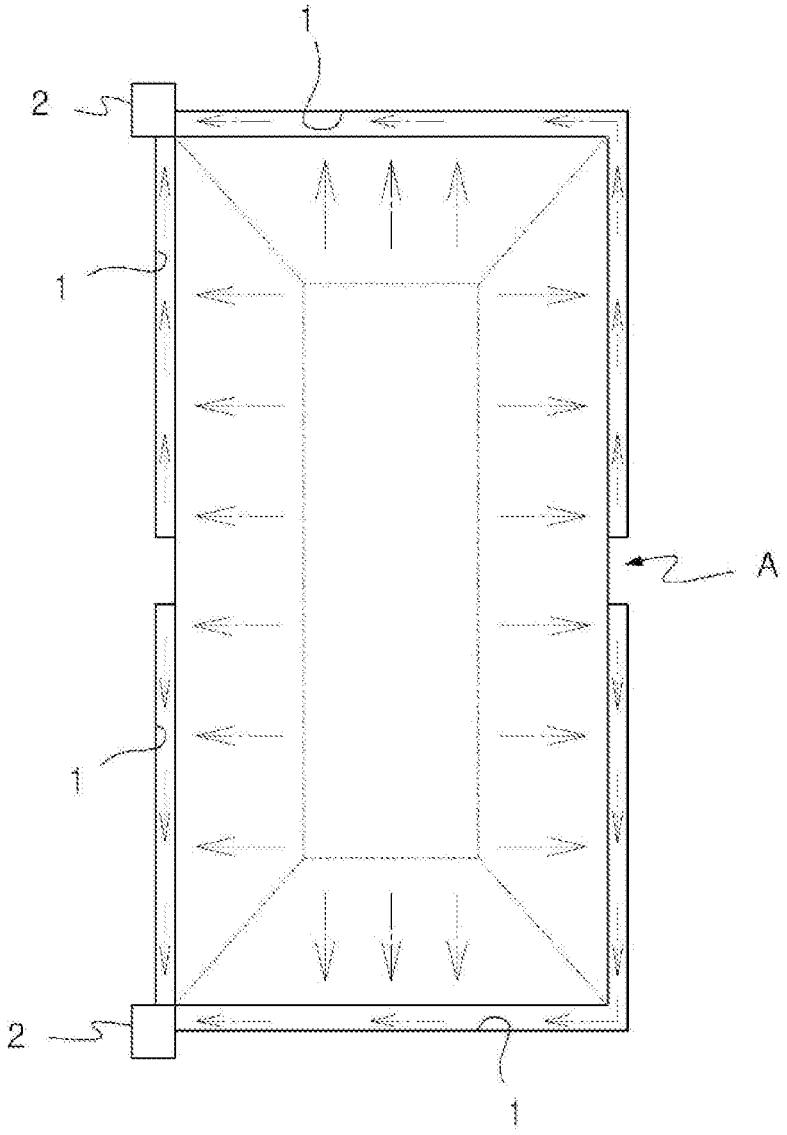
Figure 10:
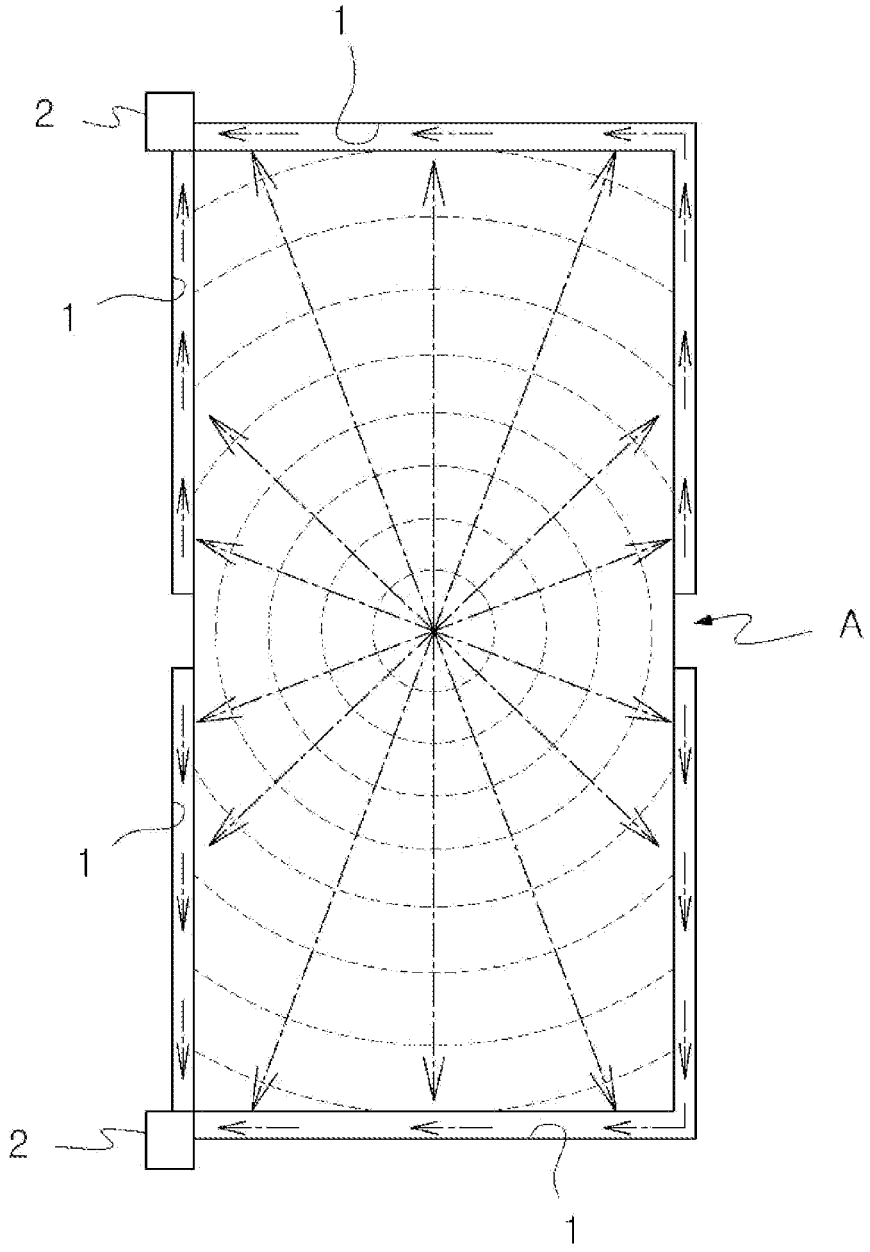

Further, as shown in FIG. 6, the entire upper surface may be inclined downward towards opposite sides, or only opposite sides of the upper surface may be inclined downward towards opposite sides as shown in FIG. 7. In addition, as shown in FIGS. 8 and 9, opposite sides and rear sides can be configured to be inclined downward towards the opposite sides and the rear sides, respectively. Further, as shown in FIG. 10, a court structure may be to have a uniform inclination in all directions about a center or may be formed of a plurality of inclined layers along circumferences of circles with radii increasing according to the distance from the center.

Alternatively, the court A may be formed in a dome shape inclined downward to an outer side from the center portion.

It is preferable that the portion where the inclination (slope) starts in the court A having the above-described configuration, that is, the portion where the corners meet (the portion indicated by a dotted line in the figures) is rounded and gently formed.

DESCRIPTION OF SYMBOLS

A. Court
1. Collecting ditch
10. Bottom surface

What is claimed is:

1. A method for constructing inclined structure of a court floor for automatic supply in a ball game, wherein a top surface of a court of a ball game stadium formed to enable ball games to be played is inclined outwardly such that a ball used for playing or practice rolls outwardly and is collected, the method comprising:

constructing a support layer on a bottom surface of the court, the support layer having an inclined upper surface; and forming a flooring on the inclined upper surface of the support layer, the flooring being formed with a plurality of panels by adhering and fixing the plurality of panels on the inclined upper surface of the support layer so as to cover the support layer, a panel material being selected from wood, synthetic resin, or rubber based on a type of the ball game stadium, or the flooring being formed by applying a flooring component of synthetic resin or rubber material on the inclined upper surface of the support layer at a constant thickness, thereby forming a double-layer structure of the support layer and the flooring, wherein the constructing a support layer comprises:

providing a mold configured by assembling a wooden panel into a quadrilateral frame shape so as to correspond to an outer circumferential portion of the court;

placing a plurality of support members inside the mold and joining the plurality of support members to a metal pipe to form an inclined surface whose upper surface corresponds to the inclined upper surface of the support layer, an inclination of the support layer being formed in a range of 0.5° to 1.5° and the inclination being predetermined based on material of the flooring and size and surface material of the ball used for playing or practice;

laying concrete into the mold, evening out an upper surface of the concrete by pushing with a wide bull floating tool having a lateral width that is bigger than a spacing between neighboring support members in a front-rear direction while placed on top of an upper surface of the support member so as to be corresponding to the inclined upper surface of the support member, and then hardening the concrete;

finishing the upper surface of the hardened concrete using a grinder or an abrader;

forming a collecting ditch along an outer circumference of the court, the collecting ditch being downwardly inclined to one or more corners of the court so that the ball used for playing or practice rolls outwardly and is collected in the collecting ditch, and then gathered to the one or more corners of the court in accordance with a slope of the collecting ditch; and installing a ball feeding means at the one or more corners of the court, the ball feeding means being configured to automatically provide the ball collected by the collecting ditch to players, wherein a portion where the inclination of each edge of the court starts is rounded and gently formed.

* * * * *